United States Patent [19]

Walker

[11] Patent Number: 4,915,373

[45] Date of Patent: Apr. 10, 1990

[54] EXERCISING MACHINE FOR ICE SKATING

[76] Inventor: Kevin W. Walker, R. R. #1, Shelburne, Ontario, Canada, L0N 1S0

[21] Appl. No.: 262,909

[22] Filed: Oct. 26, 1988

[51] Int. Cl.[4] ..... A63B 1/00; A63B 21/00

[52] U.S. Cl. ..... 272/70; 272/97; 272/131; 272/132

[58] Field of Search ..... 272/70, 97, 131, 69, 272/117, 96, 73, 93, 132, 94, 125, 126; 128/25 R; 434/247, 253, 255

[56] References Cited

U.S. PATENT DOCUMENTS 3,756,595 9/1973 Hague ..... 272/70

4,781,372 11/1988 McCormack ..... 272/70

FOREIGN PATENT DOCUMENTS 2179266 3/1987 United Kingdom ..... 272/97

*Primary Examiner*—S. R. Crow

[57] ABSTRACT

A power skating exercise device includes a pair of endless guide tracks, each of which have a power section and a return section and a pedal for each guide track. The pedal is mounted on a follower which is slidably mounted in one of the guide tracks. The follower is proportioned to pass freely along the return section. Drag is applied to the follower as it is driven along the drive section to resist the movement of the follower. A support frame is provided for supporting the user in a forwardly inclined semi-prone position which corresponds to the position assumed by a skater when accelerating forwardly.

9 Claims, 5 Drawing Sheets

EXERCISING MACHINE FOR ICE SKATING

Figure 1:
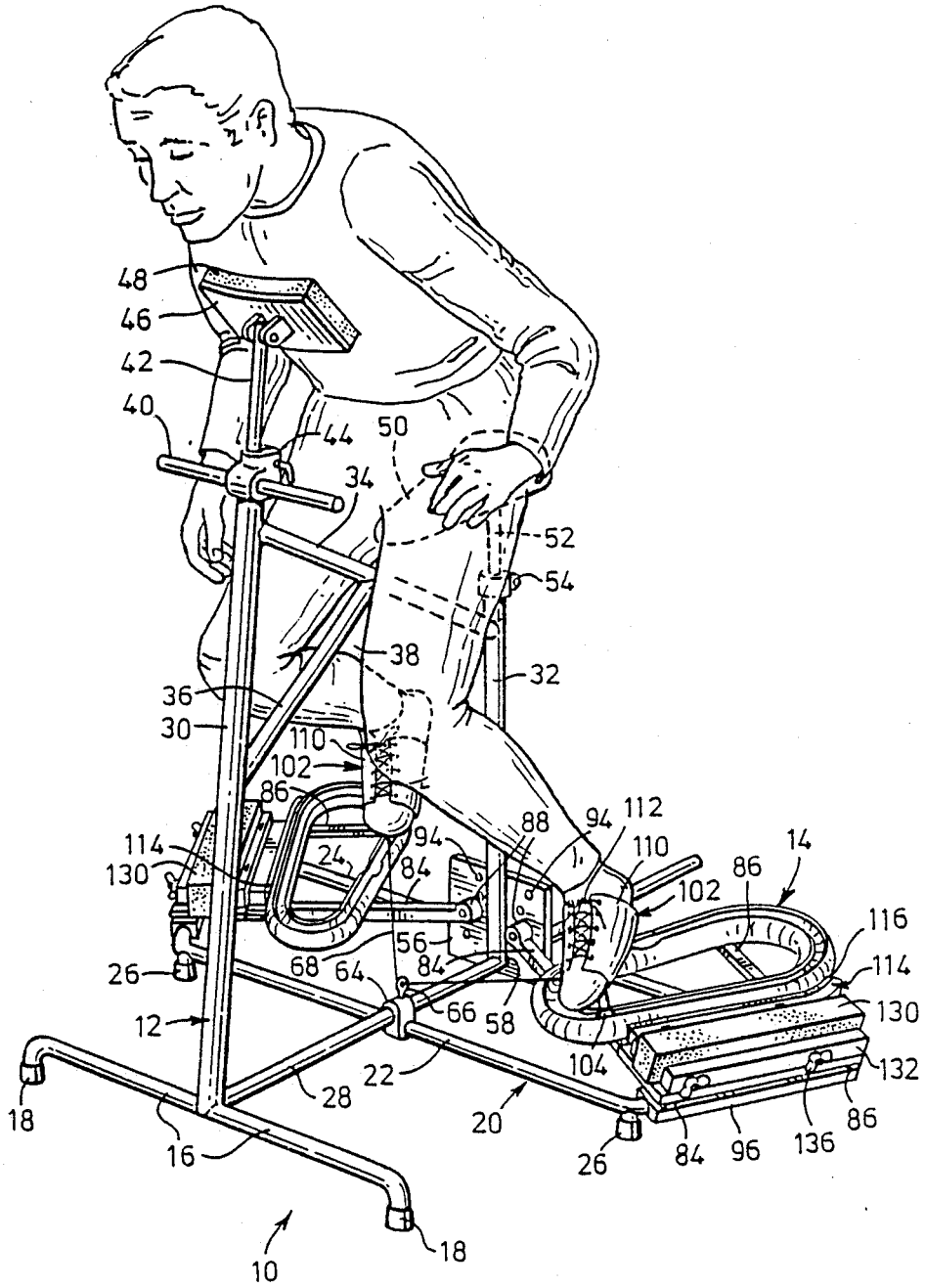

This invention relates to exercising machines. In particular, this invention relates to an exercise machine which permits the user to simulate the power skating stroke used when accelerating forwardly when skating or cross-country skiing.

PRIOR ART

An exercising device which is designed to exercise the muscles of the thighs and lower torso is disclosed in U.S. Pat. No. 3,810,613 which issued May 14, 1974 to Mildred M. Jorwa. In this device, the channels which serve to guide the skates are elliptical in shape and their paths cross one another. As a result of this configuration, the exercising motion, while it may serve to exercise the upper thighs, does not simulate a power skating action. Furthermore, there is no provision of any mechanism for applying a drag load to a portion of each guide track. In addition, it does not provide any support mechanism which would support the user in a semi-prone position.

U.S. Pat. No. 4,340,214 discloses a further form of training apparatus for skaters. In this device, the user merely moves from side to side. While this device may serve to exercise some of the muscles which a skater uses, it does not simulate the power stroke action which is one of the principal skating strokes used by an ice hockey player in order to accelerate rapidly. The power stroke is one in which the leg is extended outwardly and rearwardly when the body of the skater is inclined forwardly in a semi-prone position. The Schutzer device does not simulate the power stroke. It is designed primarily to provide an endurance exercising device suitable for use by speed skaters.

The power stroke used when ice skating, roller skating and when using the skating action during cross-country skiing is substantially the same and the use of the term "skating" herein refers to this type of action and is not limited to ice skating.

It is an object of the present invention to provide an exercise machine which will exercise the muscles used in the power stroke used during skating activities or cross-country skiing or the like.

A further object of the present invention is to provide an exercising machine which will support the body of the user in a semi-prone position while the user is performing a power skating stroke leg exercise.

According to one aspect of the present invention, there is provided an exercise machine comprising a frame having a front end and a back end, support means on the frame for supporting a user in a forwardly inclined semi-prone position which corresponds to the position assumed by a skater when accelerating forwardly, a pair of endless guide tracks arranged one on either side of the frame, each endless guide track having a power section and a return section which are connected to one another at opposite ends thereof by arcuate-shaped end sections, a pedal for each guide track, each pedal having a track follower mounted in one of the endless guide tracks for movement therealong, the track follower being proportioned to pass freely along the return section, track mounting means supporting the guide tracks on the frame in a position in which the power sections are arranged to diverge in a direction toward the back end of the frame and the return sections are located laterally inwardly from the power sections, drag means along the power section of each track for applying a load to the follower which resists the movement of the follower therealong.

According to a further aspect of the present invention, there is provided in a power skating exercise machine comprising a pair of endless guide tracks arranged one on either side of the frame, each endless guide track having a power section and a return section which are connected to one another at opposite ends thereof by arcuate shaped end sections, a pedal for each guide track, each pedal having a track follower mounted in one of the endless guide tracks for movement therealong, the track follower being proportioned to pass freely along the return section, track mounting means supporting the guide tracks on the frame in a position in which the power sections are arranged to diverge in a direction toward the back end of the frame and the return sections are located laterally inwardly from the power sections, drag means along the power section of each track for applying a load to the follower which resists the movement of the follower therealong.

Figure 2:
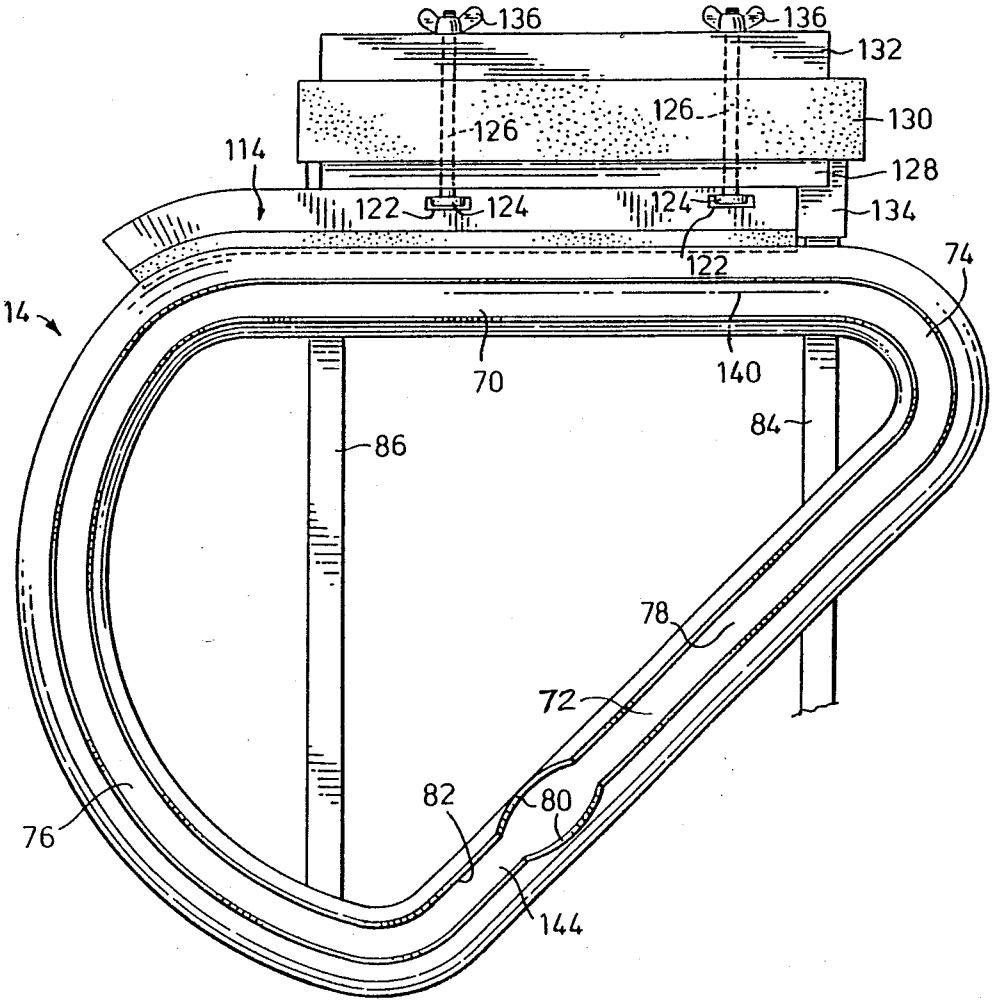
Figure 3:
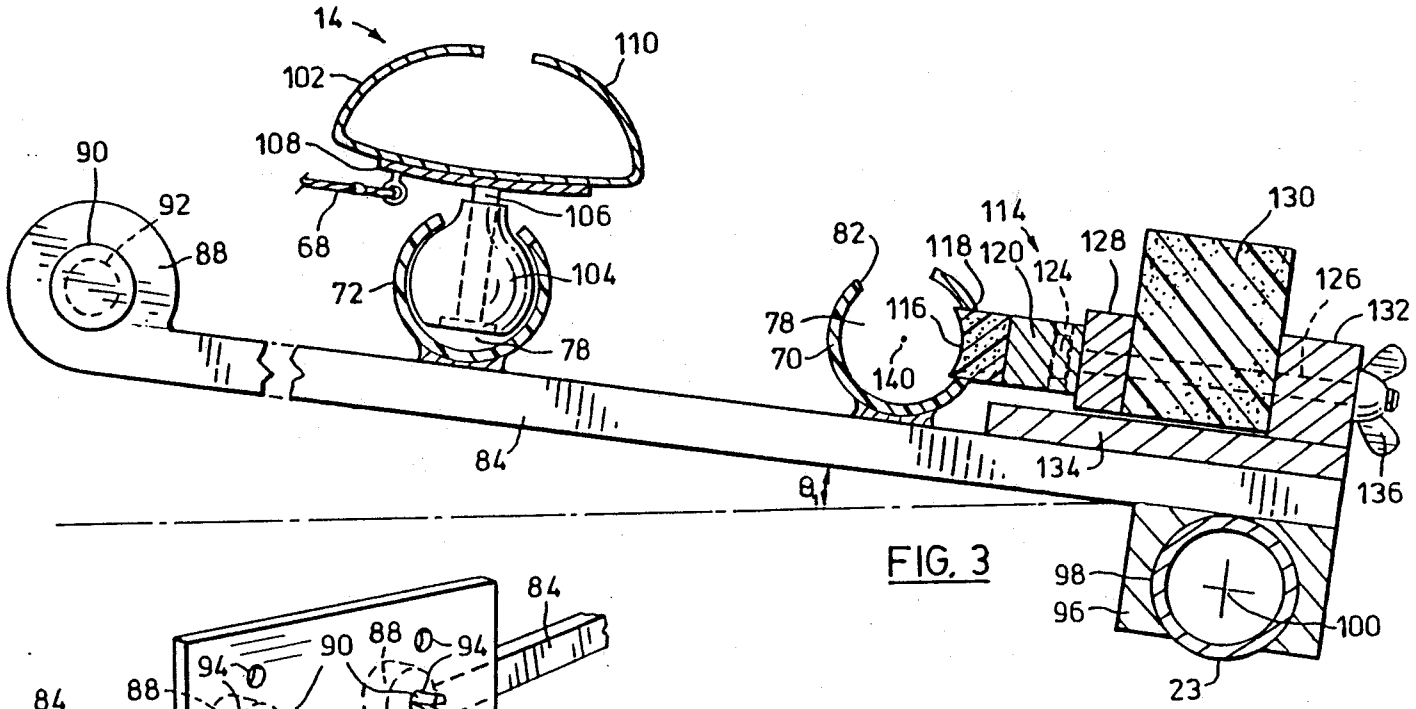
Figure 4:
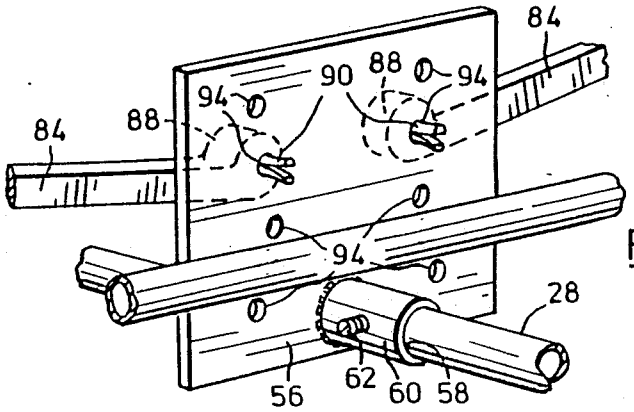
Figure 5:
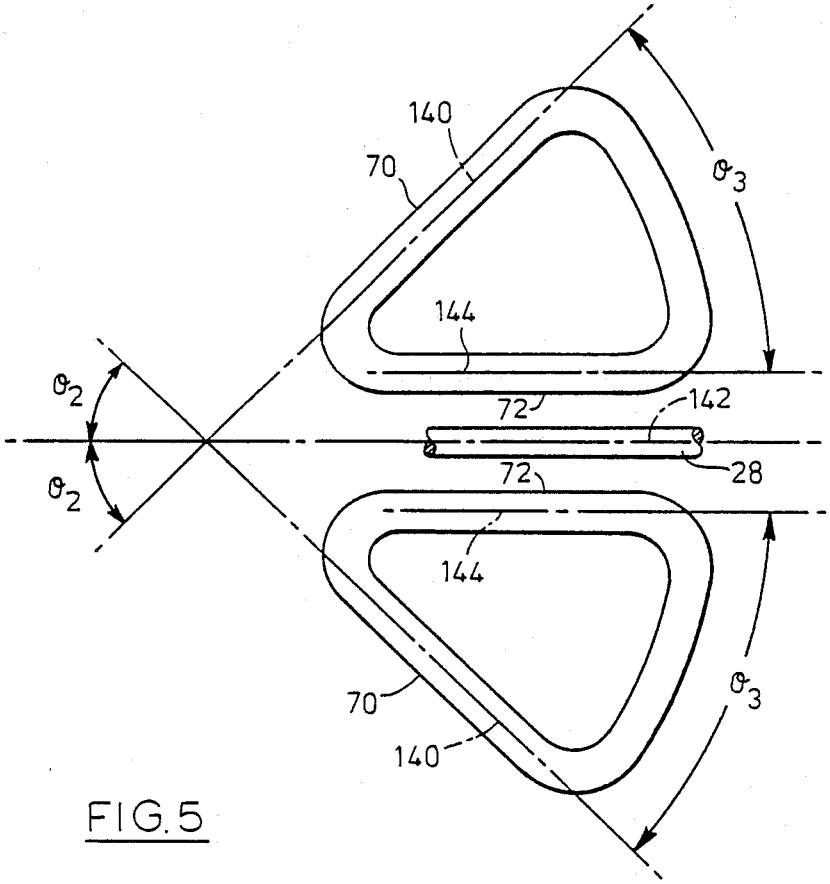

The invention will be more clearly understood with reference to the following detailed specification read in conjunction with the drawings wherein;

FIG. 1 is a pictorial front view of an exercising machine constructed in accordance with an embodiment of the present invention, FIG. 2 is a plan view of one of the guide tracks of FIG. 1, FIG. 3 is a sectional side view of the guide track of FIG. 2 showing a foot pedal mounted in the return track, FIG. 4 is a back perspective view of a portion of the frame of the exercise machine of FIG. 1, and FIG. 5 is a plan view of the guide tracks showing their orientation with respect to the axis of the frame.

Figure 6:
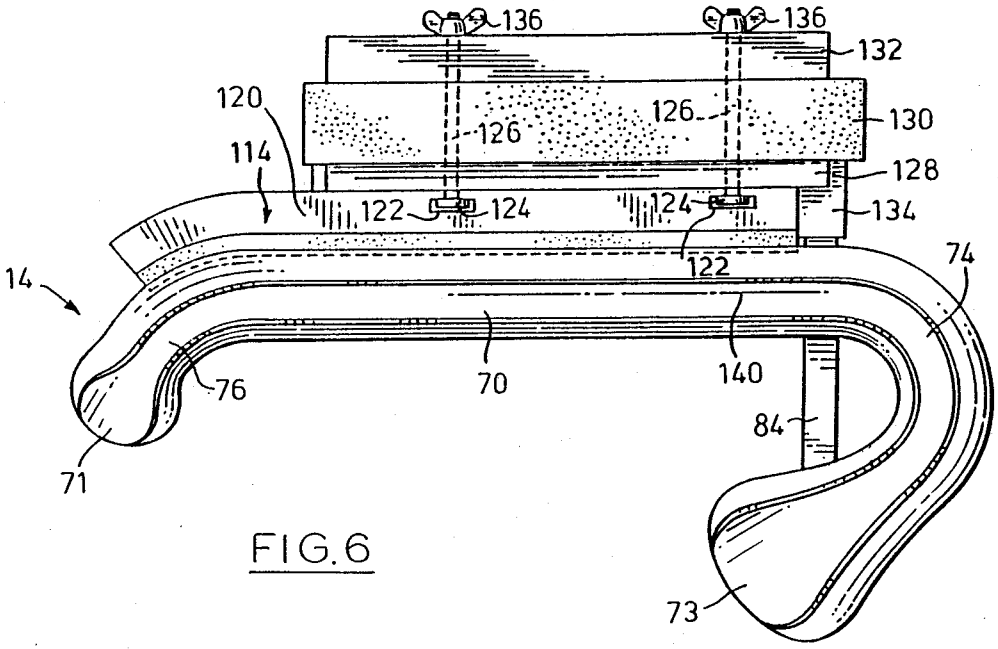

FIG. 6 is a plan view of a guide track constructed in accordance with a further embodiment of the present invention.

With reference to FIG. 1 of the drawings, the reference numeral 10 refers generally to a power skating exercise machine constructed in accordance with an embodiment of the present invention. The machine 10 consists of a frame 12 on which a pair of endless guide tracks 14 are mounted.

The frame 12 is formed from tubular metal or plastic members and includes legs 16 which extend laterally from the front end of the frame and have support feet 18. The frame also includes sub-frame 20 which consists of a tubular member which has a pair of transversely extending sections 22 and 24 which are connected by means of obliquely extending sections which diverge in a direction toward the back end of the frame. The sub-frame 20 has feet 26 on which it rests on the underlying support surface. A bar 28 extends rearwardly from the center of the legs 16 across the transverse sections 22 and 24 of the sub-frame 20. An upright front column 30 extends upwardly from the legs 16 and an upright back column 32 extends upwardly from the bar 28. A cross bar 34 extends from the upright column 32 to the upright column 30 and is upwardly inclined toward the front end of the frame. A strut 36 extends from the crossbar 34 to the upright column 30. It will be noted that an unobstructed passage 38 is formed below the crossbar 34 and strut 36 so that the knee of the user can extend to the plane of the center line of the frame and beyond without its movement being obstructed by the frame. A handlebar 40 is mounted at the upper end of the column 30 and projects laterally on opposite sides thereof. A shaft 42 is telescopically mounted in the column 30 and a clamp 44 is provided at the upper end of the column 30. The clamp 44 can be adjusted to releaseably lock the column 42 with respect to the column 30. A support pad 46 is pivotally mounted at the upper end of the shaft 42 and has a soft flexible liner 48 on its outer face.

A seat 50 is mounted on a support shaft 52 which is telescopically mounted in the upright column 32 and is adjustably secured by means of a clamp 54. The seat is forwardly and downwardly inclined to accommodate the user when the user is in a semi-prone position.

A face plate 56 has a through passage 58 formed therein which extends through a short tubular member 60 which projects from the back face of the face plate 56. The through passage 58 is proportioned to receive the bar 28 in a free-fitting sliding relationship. A screw 62 extends through the tubular member 60 and can be tightened to bear against the shaft 28 to lock the face plate in any required position along the length of the bar 28. A clamp 64 serves to slidably connect the transverse section 22 of the sub-frame with respect to the bar 28.

A screw which is formed with an eye opening 66 is mounted in and extends upwardly from the clamp 64 and serves to guide the cable 68 which is attached to the pedals 102.

As shown in FIG. 2 of the drawings, the endless track member 14 has a power section 70 and a return section 72. A front section 74 connects the front ends of the sections 70 and 72 and a back section 76 connects the back end of the sections 70 and 72. As shown in FIG. 3 of the drawings, the track 78 which is formed within the sections 70, 72, 74 and 76 is of generally circular cross-section and has a narrow slot 82 opening upwardly therefrom. The slot 82 has an enlarged portion 80 located generally centrally of the return section 72 which serves to provide access to the track 78. A pair of crossbars 84 and 86 are located toward the front and back end respectively of each endless track member 14 and extend transversely thereof. The crossbars 84 and 86 are secured to the underside of the power section 70 and return section 72 of the guide rail and serve to tie these sections together and support them in an elevated position. A boss 88 is located at the inner end of the crossbar 84. Mounting pins 90 extend through the passage 92 in the boss 88 and through one of the mounting passages 94 which are formed in the face plate 56. A saddle 96 is located at the outer end of the arm 84 and extends longitudinally to the other crossbar 86. The saddle 96 is formed with a recess 98 which is proportioned to receive the section 23 of the frame which extends between the transverse sections 22 and 24. The saddle 96 can rotate about the axis 100 to permit relocation of the passage 92 of the boss 88 in alignment with any one of the passages 94 which are formed in the face plate 56 so as to adjust the angle of inclination $\theta_1$ of the arms 84. Preferably the angle $\theta_1$ is about 25°. The adjustment which is available by reason of the plurality of mounting passes 94 in the face plate serves to permit the angle $\theta 1$ to be adjusted between 20° and 40° with the preferred angle being a matter of choice to the user.

As shown in FIG. 3 of the drawings, each pedal 102 has an onion-shaped follower member 104 which and is proportioned to fit in a free-fitting sliding and rotating relationship within the channel 78 as shown in FIG. 3. The enlarged portion 80 of the slot 82 is proportioned to permit the follower member 104 to be admitted to or removed from the track 78. The enlarged portion 80 is provided along the return section 72 rather than along the power section because the loads which are applied to the follower during its return are less likely to cause the follower to be withdrawn from the channel.

Each pedal 102 also includes a rigid foot plate 108 which is rigidly mounted on the shaft 106. The shaft 106 has a sufficient length to elevate the foot plate a substantial distance above the track to permit the foot plate to rotate freely out of contact with the track in all positions which the user's foot is likely to assume during movement of the pedal around the track. A harness 110 is secured to the foot plate 108 and is provided with a lace 112 which can be tightened or released in order to adjust the proportions of the harness to accommodate the proportions of the foot of the user.

In order to provide a greater resistance to movement of the follower along the power section of the track, I provide a braking or drag mechanism 114. This mechanism includes an elongated brake pad 116 which is in the form of a friction pad which extends through an elongated slot 118. The brake pad 116 is mounted on a rigid backing member 120 in which a pair of T-shaped recesses 122 are formed in order to accommodate the head portion 124 of a mounting bolt 126. The threaded body portion of the bolt 126 extends through a moveable jaw 128, a resilient pressure pad 130 and a fixed jaw 132. The fixed jaw 132 is mounted on a support plate 134 which extends between and is carried by the arms 84 and 86. Wing nuts 136 are threadedly mounted on the bolts 126. In order to adjust the position of the brake pad 116 with respect to the channel 78, it is merely necessary to adjust the wing nuts 136. As the brake pad 116 is withdrawn from the track 78, the pressure pad 130 is compressed. This is achieved by rotating the wing nuts 136 in the direction which results in movement of the wing nut toward the head of the bolt 126. In order to move the brake pad 116 inwardly, the wing nut 136 is rotatably driven in the opposite direction and the pressure in the pressure pad 130 will act to move the brake pad 116 inwardly. The load which is applied to the brake pad 116 by the follower 104 as it moves along the power track 78 tends to urge the brake pad outwardly from the track and this load is transferred to the resilient pressure pad 130.

As shown in FIG. 5 of the drawings, the axis 140 of the power section 70 is located at an angle $\theta_2$ with respect to the longitudinal axis 142 of the bar 28 of the frame 12. The angle $\theta_2$ is preferably set at about 45°. The angle $\theta_3$ formed between the axis 144 of the return section and the axis 142 is preferably of the order of about 45°. In use, the guide tracks are located on the frame in a manner which will permit the user to perform leg exercise movements which closely approximate the leg movements which the same person would perform during on-ice power skating drills. This is achieved by locating the starting point of the power section sufficiently close to the longitudinal axis 142 of the frame to ensure that the user will assume a 90° knee-bend at the beginning of the power stroke. The power section of the track extends rearwardly and outwardly from the longitudinal axis 142 at an angle $\theta_2$ along a path which has a sufficient length which will permit the user to obtain a substantially full leg extension before returning along the return section. In normal use, it will be understood that when a follower is being driven outwardly and rearwardly along the power section of one guide track, the follower of the other guide track will be drawn forwardly and inwardly along its return section. The cable 68 serves to transfer some of the power of the power stroke to the return stroke and as a consequence the movement of the follower along the return stroke adds some additional drag to the movement of the follower along the power section of the other guide track.

Various modifications of the present invention will be apparent to those skilled in the art without departing from the scope of the invention.

One modification is illustrated in FIG. 6 of the drawings. In this embodiment, the return section 72 of the guide track is eliminated. The power track 70 ends in an outwardly flared exit section 71 is provided at the back section 76 to facilitate the escape of the follower. Similarly, an even larger entry section 73 is provided at the entry to the front section 74.

In use, this track assembly is mounted on the frame as previously described with reference to FIG. 1 and the foot pedals are attached to one another by means of the cable 68. By providing an enlarged intersection 73, the natural return stroke of the skating action will serve to locate the follower 104 of the foot pedal 102 in the enlarged entrance and further movement along the guide track will return the follower to the power section to repeat the power stroke exercise as previously described.

In a further modification, the length of the power section 70 and the return section 72 may be made adjustable so as to accommodate skaters having different strides resulting from different leg sizes.

In another modification, the skating exercises may be performed using the endless guide tracks without the body supporting frame. The exerciser could merely lean against an adjacent wall or a separate support structure. The frame of the present invention is, however, of considerable importance in that it serves to permit the exerciser to assume an appropriate semi-prone position.

In a still further modification, the shape of the cross-section of the guide track and the follower may be changed to a somewhat more rectangular configuration and a universal joint may be incorporated in the connection between the follower and the foot pedal. In addition, alternative drag mechanisms may be used such as springs or surface irregularities formed in the guide track.

I claim:

1. A power skating exercise machine comprising:

(a) a frame having a front end and a back end, (b) support means on the frame for supporting a user in a forwardly inclined semi-prone position which corresponds to the position assumed by a skater when accelerating forwardly, (c) a pair of endless guide tracks arranged one on either side of the frame, each endless guide track having a power section and a return section which are connected to one another at opposite ends thereof by arcuate shaped end sections whereby the endless guide track follows a path which approximates the path of the power and return stroke of a skate of a skater when the skater is accelerating forwardly, (d) a pedal for each guide track, each pedal having a track follower mounted in one of the endless guide tracks for movement therealong, the track follower being proportioned to pass freely along the return section, track mounting means supporting the guide tracks on the frame in a position in which the power sections are arranged to diverge in a direction toward the back end of the frame and the return sections are located laterally inwardly from the power sections, (e) drag means along the power section of each track for applying a load to the follower which resists the movement of the follower therealong.

2. A machine as claimed in claim 1, wherein each guide track has a front end and a back end and wherein the power and return sections converge from a point adjacent the back end to a point adjacent the front end of the guide track such that the travel of the follower along the power track simulates the rearward push of the power skating stroke and the travel along the return section simulates the return skating stroke.

3. A machine as claimed in claim 2, wherein each guide track extends in an exercising plane which is inclined downwardly from opposite sides of the frame at an angle of about 25° to the horizontal plane.

4. A machine as claimed in claim 3, wherein the power section of each track is rearwardly and outwardly inclined on opposite sides of the frame at an angle of about 45°.

5. A machine as claimed in claim 1, wherein said support means comprises:

a seat and a chest support, the chest support being arranged to underlie and support the chest of the user when the user is in the semi-prone position.

6. A machine as claimed in claim 5, further comprising handle-bar means mounted on the frame and arranged to be accessible to the user when the user is in the semi-prone position.

7. A machine as claimed in claim 1, wherein the guide track is formed with a guide channel which has a generally circular cross-sectional configuration and a narrow slot which extends longitudinally of the guide channel and opens upwardly therefrom, each follower having a generally spherical-shaped end portion seated in the guide track and a support post which extends upwardly through the narrow slot to its associated pedal, the support post having a longitudinal axis about which the pedal may be rotated and the spherical end portion having a center about which the shaft may gyrate to permit the pedal to follow the normal orientation of the foot of the user during the power, reversal and return strokes of the exerciser in use.

8. A machine as claimed in claim 1, further comprising flexible cord means connecting the pedals and guide means on the frame through which the flexible cord is threaded such that a portion of the movement of one pedal along its power section causes movement of the other pedal along its return section in use.

9. A power skating exercise machine comprising:

(a) a frame having a front end and back end (b) a pair of endless guide tracks arranged one on either side of the frame, each endless guide track having a power section and a return section which are connected to one another at opposite ends thereof by arcuate shaped end sections whereby the endless guide track follows a path which approximates the path of the power and return stroke of a skate of a skater when the skater is accelerating forwardly, (c) a pedal for each guide track, each pedal having a track follower mounted in one of the endless guide tracks for movement therealong, the track follower being proportioned to pass freely along the return section, track mounting means supporting the guide tracks on the frame in a position in which the power sections are arranged to diverge in a direction toward the back end of the frame and the return sections are located laterally inwardly from the power sections, (d) drag means along the power section of each track for applying a load to the follower which resists the movement of the follower therealong.

* * * * *